US011647576B2

(12) United States Patent
Bastien

(10) Patent No.: US 11,647,576 B2
(45) Date of Patent: May 9, 2023

(54) MOTOR VEHICLE AUXILIARY LIGHTING CONTROL SYSTEMS AND METHODS

(71) Applicant: Denali Electronics LLC, East Greenwich, RI (US)

(72) Inventor: Nathan Bastien, Exeter, RI (US)

(73) Assignee: Vision X Offroad, LLC, Auburn, WA (US)

( * ) Notice: Subject to any disclaimer, the term of this patent is extended or adjusted under 35 U.S.C. 154(b) by 0 days.

(21) Appl. No.: 17/748,597

(22) Filed: May 19, 2022

(65) Prior Publication Data

US 2022/0377863 A1 Nov. 24, 2022

Related U.S. Application Data

(60) Provisional application No. 63/201,923, filed on May 19, 2021.

(51) Int. Cl.
*H05B 45/20* (2020.01)
*H05B 45/50* (2022.01)
*H05B 45/325* (2020.01)

(52) U.S. Cl.
CPC ..... *H05B 45/50* (2020.01); *H05B 45/20* (2020.01); *H05B 45/325* (2020.01)

(58) Field of Classification Search
CPC ..... H05B 45/10; H05B 45/20; H05B 45/30; H05B 45/325; H05B 45/50; H05B 47/10
See application file for complete search history.

(56) References Cited

U.S. PATENT DOCUMENTS

2011/0084628 A1* 4/2011 Welten ..... H05B 47/175 315/312
2022/0330400 A1* 10/2022 Unterweger ..... H05B 45/30

* cited by examiner

*Primary Examiner* — Jimmy T Vu
(74) *Attorney, Agent, or Firm* — Grossman, Tucker, Perreault & Pfleger PLLC; Paul J. Kroon, Jr.

(57) ABSTRACT

A vehicle lighting system includes a rotatable, depressible, rotary dimmer switch with a light emitting diode ring indicator and a vehicle lighting controller. The vehicle lighting controller controls the operation of at least a first lighting circuit and a second lighting circuit. A digital input from the rotary dimmer switch places the controller in a first configuration mode or a second configuration mode. The digital input from the rotary dimmer also switches between apply configuring the first lighting circuit or the second lighting circuit. The LED illuminates in a first color for the first circuit and a second color for the second circuit. The rotary dimmer adjusts the operating parameter and/or the overcurrent protection associated with the first lighting circuit and the second lighting circuit.

20 Claims, 6 Drawing Sheets

MOTOR VEHICLE AUXILIARY LIGHTING CONTROL SYSTEMS AND METHODS

CROSS REFERENCE TO RELATED APPLICATIONS

The present application claims the benefit of U.S. Provisional Application Ser. No. 63/201,923, filed May 19, 2021, which is fully incorporated herein by reference.

TECHNICAL FIELD

The present disclosure relates to lighting controls, more specifically lighting controls for use on motor vehicles.

BACKGROUND

Auxiliary lighting systems may include lighting systems that are installed on motor vehicles that are not required by federal, state, or local regulation. Often such auxiliary lighting systems are used to personalize a motor vehicle based on the likes and desires of the vehicle operator. Such auxiliary light systems may be disposed on the interior or exterior of the motor vehicle. On motor vehicles classified as "motorcycles" and "all terrain vehicles (ATVs)," including Can-Am and Stryker type vehicles, such auxiliary lighting systems may be disposed on frame members, roll cages, and suspension components, making the lighting systems highly visible to pedestrians and other motorists.

BRIEF DESCRIPTION OF THE DRAWINGS

Features and advantages of various embodiments of the claimed subject matter will become apparent as the following Detailed Description proceeds, and upon reference to the Drawings, wherein like numerals designate like parts, and in which:

Figure 1:
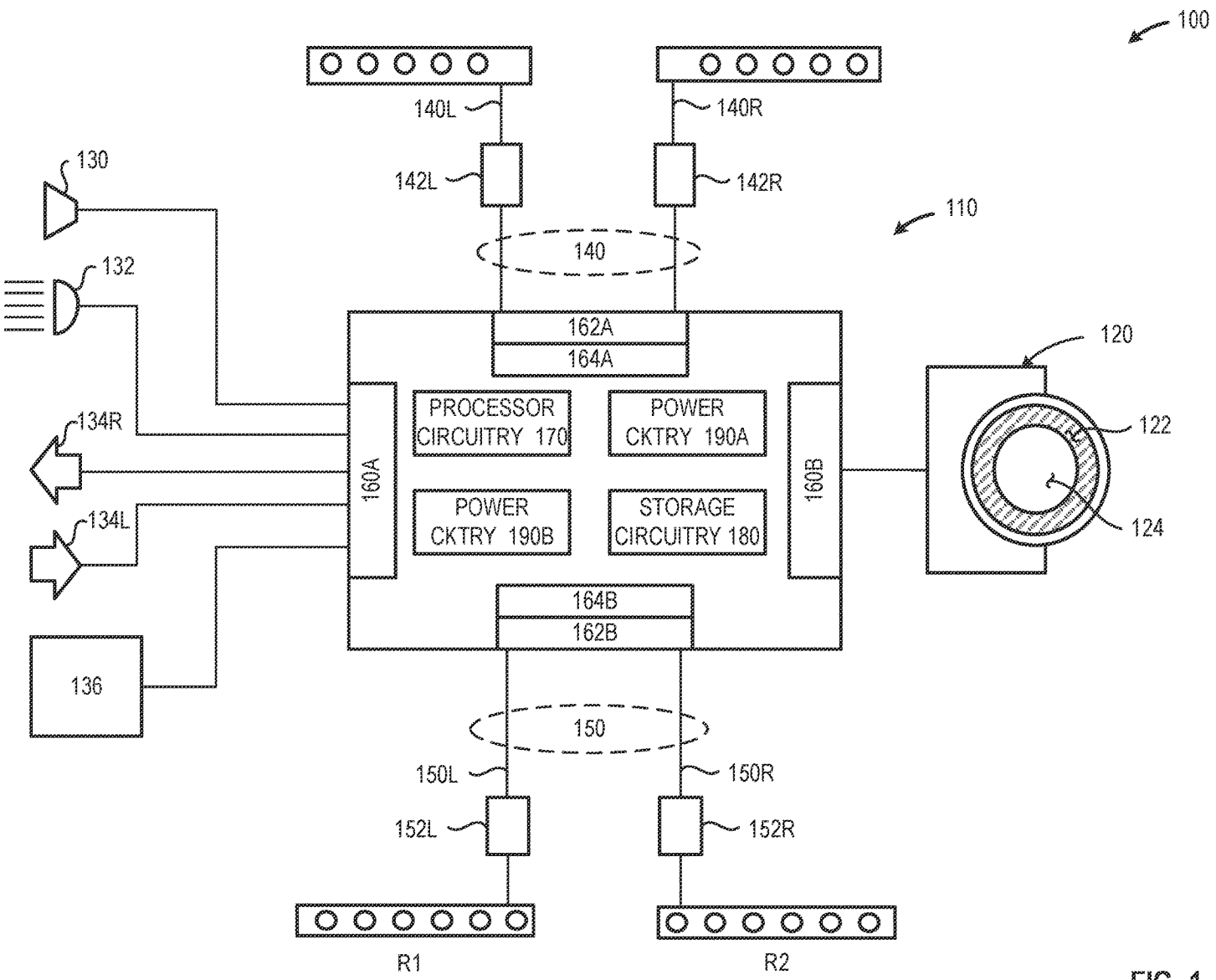
FIG. 1 is a schematic that depicts an illustrative vehicle lighting system that includes control circuitry, a depressible rotary dimmer that includes a multi-color LED indicator disposed about the base of a rotary dimmer switch, a plurality of inputs, a first lighting circuit that includes a left channel and a right channel, and a second lighting circuit that includes a left channel and a right channel, in accordance with at least one embodiment described herein.

Although the following Detailed Description will proceed with reference being made to illustrative embodiments, many alternatives, modifications and variations thereof will be apparent to those skilled in the art.

DETAILED DESCRIPTION

The auxiliary lighting control systems and methods disclosed herein beneficially and advantageously integrate the operation of one or more auxiliary lighting systems with existing vehicle operation and/or safety systems such as a vehicle horn, turn signals, and high-beam headlight operation. Such integration beneficially permits the operation of the auxiliary lighting control systems and methods disclosed herein to function in a complimentary manner that does not detract from the functionality or safety of existing vehicle systems. The systems and methods disclosed herein may use a compact user interface that includes a depressible rotary dimmer switch surrounded by a multicolor, light emitting diode (LED) display about the base of the rotary dimmer switch. The systems and methods disclosed herein also include control circuitry that permits the vehicle operator to alter, adjust, and/or control the operation of the auxiliary lighting system, but also alter or adjust the overcurrent protection provided to each auxiliary lighting system, thereby permitting the systems and methods disclosed herein to control virtually any auxiliary lighting system manufacturer or type of auxiliary lighting.

The systems and methods disclosed herein include control circuitry that receives inputs indicative of the operational status of a number of vehicle systems including an audible warning device (i.e., horn), turn indicators, and high-beam headlights. The control circuitry receives a digital user input and an analog user input provided via a depressible rotary dimmer switch that can be mounted in a convenient location accessible by the vehicle operator. The control circuitry further includes a plurality of outputs including a first channel (e.g., a multi-channel including, but not limited to, two-channel such as left/right) lighting circuit and a second channel (e.g., a multi-channel including, but not limited to, two-channel such as left/right) lighting circuit. The first channel lighting circuit and/or the second channel lighting circuit includes a pulse-width modulation (PWM) power supply to control the luminous output of the lighting (e.g., LED lighting). The vehicle operator, via the depressible rotary dimmer switch, controls the luminous output of the first channel lighting circuit and the second channel lighting circuit by depressing the rotary dimmer switch to select a lighting circuit and then rotating the dimmer switch to provide the desired level of luminous output of the devices coupled to the respective circuit. The vehicle operator, via the depressible rotary dimmer switch, controls the overcurrent protection for each of the first channel lighting circuit and the second channel lighting circuit by depressing the rotary dimmer switch for a predetermined amount of time (e.g., 10 seconds), then rotating the dimmer switch to provide the desired level of overcurrent protection for the devices coupled to the respective circuit. The color of the multicolor, LED display about the base of the rotary dimmer switch indicates the channel lighting circuit being modified (e.g., green=first channel lighting circuit and blue=the second channel lighting circuit).

A vehicle lighting control system is provided. The system may include: a user input device that includes: a rotatable and depressible rotary dimmer switch having a crown and a base, the dimmer switch to provide a digital output when depressed and an analog output when rotated; a multi-color light emitting diode (LED) ring indicator disposed proximate and about at least a portion of the base of the rotary dimmer switch; control circuitry that includes: at least one input signal interface to: receive signals from each of a plurality of vehicular systems; receive the analog output and the digital output from the dimmer switch; at least one output signal interface to: provide a first output signal to control one or more operational parameters associated with a first lighting circuit, the first lighting circuit including one or more independent lighting circuits (such as, but not limited to, a first left lighting circuit and a first right lighting circuit); and provide a second output signal to control one or more operational parameters associated with a second lighting circuit, the second lighting circuit including one or more independent lighting circuits (such as, but not limited to, a second left lighting circuit and a second right lighting circuit); at least one adjustable overcurrent protection device; non-transitory storage circuitry to store one or more machine-readable instruction sets; and processor circuitry to: enter a first configuration mode or a second configuration mode upon receipt of the digital signal from the dimmer switch; receive the analog signal from the dimmer switch and adjust the one or more operational parameters of at least one of the first lighting circuit or the second lighting circuit upon entering the first configuration mode; and receive the analog signal from the dimmer switch and adjust an overcurrent protection level of at least one of the first lighting circuit or the second lighting circuit upon entering the second configuration mode.

A vehicle lighting controller is provided. The controller may include: at least one input signal interface to: receive signals from each of a plurality of vehicular systems; receive an analog output and a digital output from a dimmer switch; at least one output signal interface to: provide a first output signal to control one or more operational parameters associated with a first lighting circuit, the first lighting circuit including one or more independent lighting circuits (such as, but not limited to, a first left lighting circuit and a first right lighting circuit); and provide a second output signal to control one or more operational parameters associated with a second lighting circuit, the second lighting circuit including one or more independent lighting circuits (such as, but not limited to, a second left lighting circuit and a second right lighting circuit); at least one adjustable overcurrent protection device; non-transitory storage circuitry to store one or more machine-readable instruction sets; and processor circuitry to: enter at least one of a first configuration mode or a second configuration mode upon receipt of the digital signal from the dimmer switch; receive the analog signal from the dimmer switch and adjust the one or more operational parameters of at least one of the first lighting circuit or the second lighting circuit upon entering the first configuration mode; and receive the analog signal from the dimmer switch and adjust an overcurrent protection level of at least one of the first lighting circuit or the second lighting circuit upon entering the second configuration mode.

As used herein, the term "operational parameters" refers to any luminous output property and/or combination of luminous output properties including but not limited to, luminous intensity, frequency of luminous output, duration of luminous output, duration of an absence of luminous output, pulse width of a pulse-width modulated illumination source, and/or pulse frequency of a pulse-width modulated illumination source.

FIG. 1 is a schematic that depicts an illustrative auxiliary lighting system 100 that includes control circuitry 110, a depressible rotary dimmer 120 that includes a multi-color LED indicator 122 (such as, but not limited to, an annular multi-color LED indicator) disposed about the base of a rotary dimmer switch 124, a plurality of inputs 130, 132, 134, and 136, a first lighting circuit 140 including one or more independent lighting circuits (such as, but not limited to, a left channel 140L and a right channel 140R), and a second lighting circuit 150 including one or more independent lighting circuits (such as, but not limited to, a left channel 150L and a right channel 150R), in accordance with at least one embodiment described herein. The depressible rotary dimmer 120 is configured to be mounted in a location proximate the vehicle operator (such as, but not limited to, flush mounted or mounted to an ATV, snowmobile, and/or motorcycle handlebar) and provides the vehicle operator with the ability to independently adjust, via the control circuitry 110, one or more operational parameters, such as the behavior and/or the luminous output, associated with the lighting devices coupled to the first lighting circuit 140 and one or more operational parameters associated with the lighting devices coupled to the second lighting circuit 150. Additionally, the depressible rotary dimmer 120 also provides the vehicle operator with the ability to independently adjust, via the control circuitry 110, the overcurrent protection for the first lighting circuit 140 and the overcurrent protection for the second lighting circuit 150.

The control circuitry 110 may include any number and/or combination of electrical devices, semiconductor components, logic elements, and/or programmable devices capable of receiving a plurality of inputs from various vehicular systems such as a vehicle audible device 130 (e.g., a horn or the like), a vehicle illumination system 132, vehicle turn indicators 134L/134R, a vehicle accessory circuit 136; one or more digital inputs from the depressible rotary dimmer 120, and one or more analog inputs from the depressible rotary dimmer 120 to provide one or more adjustable or variable control outputs to the first lighting circuit 140 and/or the second lighting circuit 150. In embodiments, the first lighting circuit 140 may include a plurality of individual lighting circuits, for example a left lighting circuit 140L and a right lighting circuit 140R. Similarly, the second lighting circuit 150 may include a plurality of individual lighting circuits, for example a left lighting circuit 150L and a right lighting circuit 150R. One or more lighting devices, such as single or multi-color LED elements may be operably coupled to the first lighting circuit 140 via one or more modular connectors 142L and/or 142R. Similarly, one or more lighting devices, such as single or multi-color LED elements may be operably coupled to the second lighting circuit 150 via one or more modular connectors 152L and/or 152R.

The control circuitry 110 may include one or more input interfaces 160A-160*n* (two depicted in FIG. 1, 160A and 160B) to receive one or more signals generated by one or more vehicle systems and one or more signals from the depressible rotary dimmer 120. The control circuitry 110 may include one or more output interfaces 162A-162*n* (two depicted in FIG. 1, 162A and 162B) to provide power to the first lighting circuit 140 and/or the second lighting circuit 150. The control circuitry 110 may also include one or more direct current (DC) power supplies 190A-190*n* (two depicted in FIG. 1, 190A and 190B), for example one or more Pulse-Width Modulated (PWM) power supplies. The control circuitry 110 may also include one or more user-adjustable first overcurrent protection devices 164A operably coupled to the first lighting circuit 140 and one or more user-adjustable second overcurrent protection devices 164B operably coupled to the second lighting circuit 150. In embodiments, the vehicle's electrical system (e.g., alternator/battery) provides 12VDC or 24VDC power to the control circuitry 110.

The control circuitry 110 may also include processor circuitry 170 and non-transitory storage circuitry 180 to store one or more sets of machine readable instructions, one or more programs, and/or one or more applications that receive a plurality of inputs from the one or more vehicular systems and the depressible rotary dimmer 120 to control one or more operational aspects of the first lighting circuit 140 and/or one or more operational aspects of the second lighting circuit 150. In embodiments, the non-transitory storage circuitry 180 may include but is not limited to: read only memory (ROM) circuitry; electrically erasable programmable read only memory (EEPROM) circuitry; optical storage circuitry; electromagnetic storage circuitry; electro-resistive storage circuitry; or combinations thereof. The processor circuitry 170 executes the machine-readable instructions stored in the operably coupled non-transitory memory circuitry 180.

The control circuitry 110 includes at least one operating mode to control one or more operational parameters of the first lighting circuit 140 and/or one or more operational parameters of the second lighting circuit 150, a first configuration mode to configure one or more operational parameters of the first lighting circuit 140 and/or one or more operational parameters of the second lighting circuit 150, and a second configuration mode to configure one or more parameters associated with the overcurrent protection circuitry 164A for the first lighting circuit 140 and/or one or more parameters associated with the overcurrent protection circuitry 164B for the second lighting circuit 150.

The depressible rotary dimmer 120 provides input to the control circuitry 110 to place the control circuitry 110 in the operating mode, the first configuration mode, or the second configuration mode. In at least some embodiments, the control circuitry 110 defaults to the operating mode in the absence of vehicle operator input for a defined period of time (e.g., more than 10 seconds, 20 seconds, 30 seconds, or 60 seconds). In at least some embodiments, a relatively short press (e.g., less than 1 second, less than 2 seconds, or less than 5 seconds) of the rotary dimmer switch 124 places the control circuitry in the first configuration mode. In the first configuration mode, turning the rotary dimmer switch 124 increases or decreases one or more operational parameters (e.g., luminous output) of the first lighting circuit 140. The color of the LED indicator 122 (which partially or completely surrounds the rotary dimmer switch 124) provides the vehicle operator with a visual indication of the lighting circuit being adjusted. For example, the LED indicator 122 continuously or steadily illuminating in a first color (e.g., green) to provide the vehicle operator with a visual indication that the operational parameter adjustment will be applied to the first lighting circuit 140. The degree to which the LED indicator 122 is illuminated provides a visual indication of the level of adjustment to the operational parameter. For example, if the operational parameter being adjusted is the power supplied to the first lighting circuit 140, no illumination of the LED indicator 122 would correspond to 0% power supplied to the lighting circuit; illumination of the LED indicator 122 from the 12 o'clock to 6 o'clock position (i.e., 50% illumination) would correspond to 50% power supplied to the lighting circuit; and full illumination of the LED indicator 122 (i.e., 100% illumination) would correspond to 100% power supplied to the lighting circuit.

Similarly, the LED indicator 122 continuously or steadily illuminating in a second color (e.g., blue) provides the vehicle operator with a visual indication that the operational parameter adjustment will be applied to the second lighting circuit 150. After being placed in the first configuration mode a double-press or double-tap of the rotary dimmer switch 124 permits the adjustment of one or more operational parameters associated with the second lighting circuit 150. In embodiments, when placed in the first configuration mode, double-clicking the rotary dimmer switch 124 switches the control circuitry 110 between configuring the first lighting circuit 140 and the second lighting circuit 150.

In at least some embodiments, a relatively longer press (e.g., greater than 5 seconds, greater than 10 seconds, or greater than 20 seconds) of the rotary dimmer switch 124 places the control circuitry in the second configuration mode. In the second configuration mode, turning the rotary dimmer switch 124 increases or decreases the level of overcurrent protection provided by the control circuitry 110 to either or both the first lighting circuit 140 and/or the second lighting circuit 150. Once again, the color of the LED indicator 122 at least partially surrounding the rotary dimmer switch 124 provides the vehicle operator with a visual indication of whether the overcurrent protection associated with the first lighting circuit 140 or the overcurrent protection associated with the second lighting circuit 150 is being adjusted. In the second configuration mode the LED indicator 122 blinks or flashes ON/OFF at a defined rate, such as 1.5 Hz, to indicate that the control circuitry 110 is in the second configuration mode. For example, when the LED indicator 122 blinks or flashes in a first color (e.g., green) the vehicle operator is provided with a visual indication that the overcurrent protection adjustment will be applied to the overcurrent protection circuitry 164A associated with the first lighting circuit 140. The degree to which the LED indicator 122 is illuminated provides a visual indication of the level (from 1 amp to 20 amps) of overcurrent protection applied to the overcurrent protection circuitry 164 associated with the respective lighting circuit. For example, if the operational parameter being adjusted is the power supplied to the lighting circuit, no illumination of the LED indicator 122 would correspond to an overcurrent protection of 1A; illumination of the LED indicator 122 from the 12 o'clock to 6 o'clock position (i.e., 50% illumination) would correspond to an overcurrent protection of 10A; and full illumination of the LED ring indicator 122 (i.e., 100% illumination) would correspond to an overcurrent protection of 20A.

The depressible rotary dimmer 120 thus provides two inputs to the control circuitry 110. A first, digital input is generated by depressing, pressing, or otherwise vertically displacing the rotary dimmer switch 124. In embodiments, the control circuitry 110 uses the digital signal provided by the depressible rotary dimmer 120 to determine whether to enter the first configuration mode by depressing the rotary dimmer switch 124 for a relatively short duration or the second configuration mode by depressing the rotary dimmer switch 124 for a relatively long duration. In embodiments, the control circuitry 110 uses the digital signal provided by the depressible rotary dimmer 120 to determine whether the adjustments or changes entered by the vehicle operator apply to the first lighting circuit 140 or the second lighting circuit 150.

The depressible rotary dimmer 120 provides a second, analog input to the control circuitry 110. In the first configuration mode, the control circuitry 110 uses the analog input to upwardly or downwardly adjust the one or more operating parameters associated with either the first lighting circuit 140 or the second lighting circuit 150. In the second configuration mode, the control circuitry 110 uses the analog input to upwardly or downwardly adjust the level of overcurrent protection provided by the overcurrent protection circuitry 164 associated with either the first lighting circuit 140 or the second lighting circuit 150. The LED indicator 122 provides a display (e.g., an annular display) that is proportional to the output of the rotary dimmer switch 124. The LED indicator 122 provides a multi-color output in which a first color is associated with the first lighting circuit 140 and a different second color is associated with the second lighting circuit 150.

The control circuitry 110 receives input signals from any number of vehicular systems. In embodiments, some or all of the input signals may include binary input signals. Example binary signals include, but are not limited to, a signal indicative of an audible warning device 130 (e.g., horn) activation, a signal indicative of activation of enhanced illumination (e.g., 'high beams' or similar), a signal representative of a right turn signal indicator 134R, and/or a signal representative of a left turn signal 134L. In embodiments, some or all of the input signals received by the control circuitry 110 may include analog or non-binary signals generated by one or more vehicle accessory systems 136. Example analog or non-binary signals include, but are not limited to, a signal that includes data representative of the pressure applied to the brakes by a vehicle operator, a signal that includes data representative of the throttle position of the vehicle, a signal that includes data representative of the operating voltage of the vehicle electrical system, or combinations thereof.

The control circuitry 110 generates one or more output signals to control, alter, or adjust one or more operational parameters of one or more lighting circuits operably coupled to the control circuitry 110. In embodiments, the control circuitry 110 generates one or more output signals to control, alter, or adjust one or more operational parameters of a first lighting circuit 140 that may include either or both a right lighting circuit 140R and/or a left lighting circuit 140L. In embodiments, the control circuitry 110 generates one or more output signals to control, alter, or adjust one or more operational parameters of a second lighting circuit 150 that may include either or both a right lighting circuit 150R and/or a left lighting circuit 150L. In embodiments, the first lighting circuit 140 may provide power to one or more LED lighting devices. In such embodiments, the control circuitry 110 may generate a PWM output signal to control the frequency, duration, and/or luminous output of one or more LEDs operably coupled to the first lighting circuit 140. In embodiments, the second lighting circuit 150 may provide power to one or more LED lighting devices. In such embodiments, the control circuitry 110 may generate a PWM output signal to control the frequency, duration, and/or luminous output of one or more LEDs operably coupled to the second lighting circuit 150.

Figure 2:
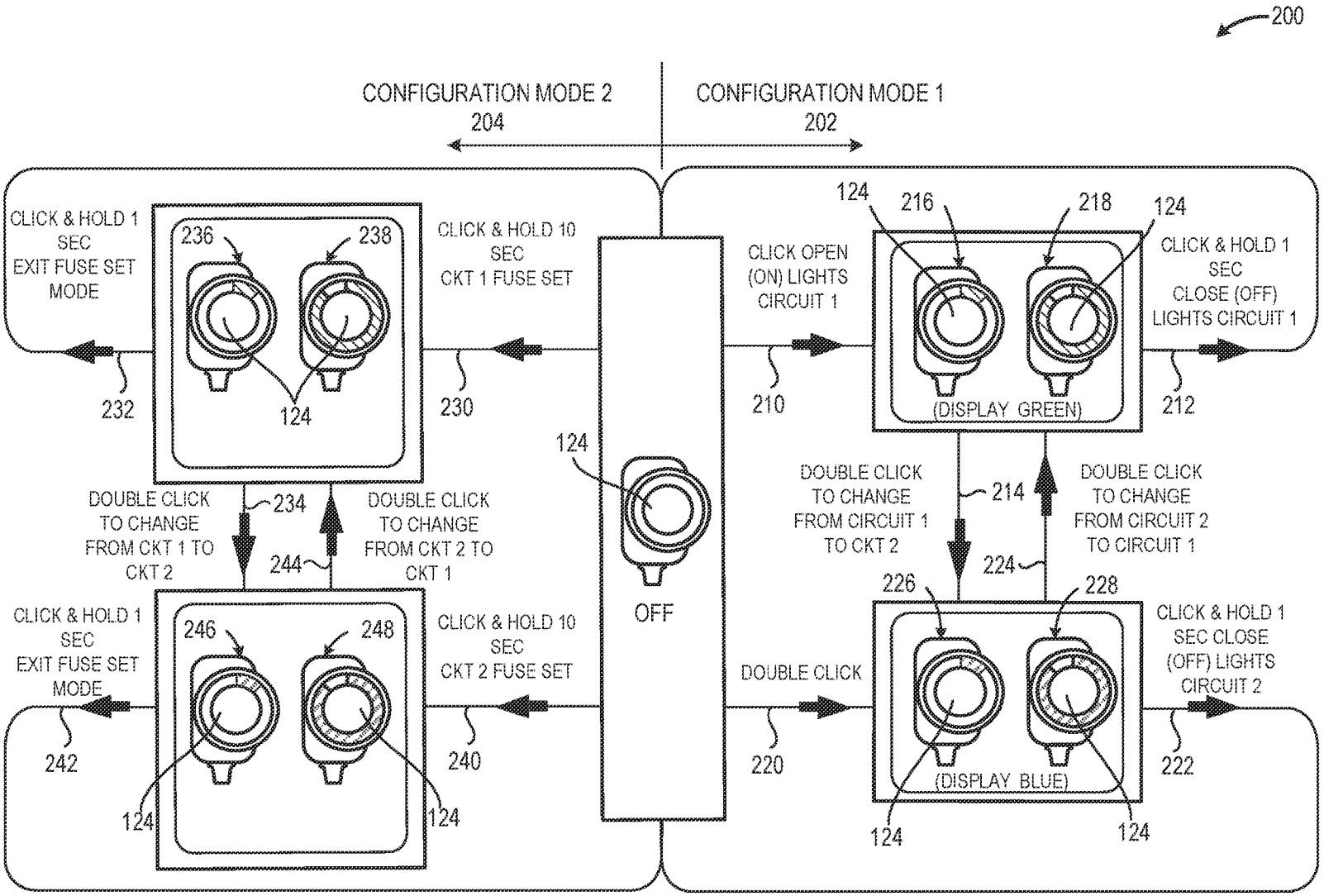
FIG. 2 is a schematic diagram that depicts the possible operations performed by the control circuitry when in the first configuration mode and the second configuration mode, in accordance with at least one embodiment described herein.

FIG. 2 is a schematic diagram 200 that depicts possible operations performed by the control circuitry 110 when in the first configuration mode 202 and the second configuration mode 204, in accordance with at least one embodiment described herein. As depicted in FIG. 2, at 210, a single click of the rotary dimmer switch 124 causes the control circuitry 110 to enter the first configuration mode 202 in which rotating the rotary dimmer switch 124 alters, adjusts, sets, and/or changes one or more operating parameters associated with the first lighting circuit 140. For example, rotating the rotary dimmer switch 124 may alter, adjust, set, and/or change the power supplied to one or more lighting devices operably coupled to the first lighting circuit 140. In the first configuration mode 202, the LED indicator 122 illuminates in a first color (e.g., green) when configuring the first lighting circuit 140. At 216, the partially illuminated LED indicator 122 indicates the control circuitry 110 is supplying approximately 10% of full power output to the devices coupled to the first lighting circuit 140. At 218, the nearly fully illuminated LED indicator 122 indicates the control circuitry 110 is supplying approximately 90% of full power output to the devices coupled to the first lighting circuit 140. At 212, clicking and holding the rotary dimmer switch 124 for a defined period of time (e.g., 1 second) interrupts the power supply to the first lighting circuit 140, causing the first lighting circuit 140 to enter an OFF state. At 214, double clicking the rotary dimmer switch 124 switches the control circuitry 110 from configuring one or more parameters associated with the first lighting circuit 140 to configuring one or more parameters associated with the second lighting circuit 150.

In the first configuration mode 202, the LED indicator 122 illuminates in a second color (e.g., blue) when configuring the second lighting circuit 150. At 220, a double click of the rotary dimmer switch 124 causes the control circuitry 110 to enter the first configuration mode 202 in which rotating the rotary dimmer switch 124 alters, adjusts, sets, and/or changes one or more operating parameters associated with the second lighting circuit 150. For example, rotating the rotary dimmer switch 124 may alter, adjust, set, and/or change the power supplied to one or more lighting devices operably coupled to the second lighting circuit 150. At 226, the partially illuminated LED indicator 122 indicates the control circuitry 110 is supplying approximately 10% of full power output to the devices coupled to the second lighting circuit 150. At 228, the nearly fully illuminated LED indicator 122 indicates the control circuitry 110 is supplying approximately 90% of full power output to the devices coupled to the second lighting circuit 150. At 222, clicking and holding the rotary dimmer switch 124 for a defined period of time (e.g., 1 second) interrupts the power supply to the second lighting circuit 150, causing the second lighting circuit 150 to enter an OFF state. At 224, double clicking the rotary dimmer switch 124 switches the control circuitry 110 from configuring one or more parameters associated with the second lighting circuit 140 to configuring one or more parameters associated with the first lighting circuit 150.

The vehicle operator places the control circuitry 110 in the second configuration mode 204 by pressing and holding the rotary dimmer switch 124 for greater than a defined time interval (e.g., 10 seconds). In the second configuration mode, the vehicle operator is able to adjust the level of overcurrent protection provided to the lighting circuit 140, 150 by the respective overcurrent protection circuity 164A, 164B. In embodiments, the control circuitry 110 includes mode memory logic when placed in the second configuration mode 204. The mode memory logic stores the identity of the last lighting circuit accessed by the control circuitry in the second configuration mode 204 and automatically returns the control circuitry 110 to the last accessed lighting circuit when the second configuration mode 204 is re-entered. Thus, if overcurrent protection circuitry 164B associated with the second lighting circuit 150 was last accessed by the control circuitry 110 while in the second configuration mode 204, when the rotary dimmer switch 124 is pressed and held for greater than the defined time interval, the control circuitry 110 will enter the second configuration mode 204 and will again access the overcurrent protection circuitry 164B associated with the second lighting circuit 150. While in the second configuration mode 204, the vehicle user can reversibly switch between setting or adjusting the overcurrent protection provided by the overcurrent protection circuitry 164A associated with the first lighting circuit 140 to the overcurrent protection provided by the overcurrent protection circuitry 164B associated with the second lighting circuit 150 by double clicking the rotary dimmer switch 124.

As depicted in FIG. 2, at 230, by pressing and holding the rotary dimmer switch 124 for a time greater than a defined time interval (e.g., greater than 10 seconds), the control circuitry 110 is placed in the second configuration mode 204. The control circuitry 110 accesses the last accessed overcurrent protection circuitry 164A or 164B. In the second configuration mode 204, rotating the rotary dimmer switch alters, adjusts, or changes the level of overcurrent protection provided to the first lighting circuit 140 by the overcurrent protection circuitry 164A. In the second configuration mode 204, the LED indicator 122 illuminates in a first color (e.g., green) when configuring the overcurrent protection limit for the overcurrent protection circuitry 164A associated with the first lighting circuit 140. At 236, the partially illuminated LED indicator 122 indicates the overcurrent protection limit applied by the overcurrent protection circuitry 164A to the first lighting circuit 140 is approximately 10% of full range (e.g., 2 amps of a maximum 20 amps). At 238, the nearly fully illuminated LED indicator 122 indicates the overcurrent protection limit applied by the overcurrent protection circuitry 164A to the first lighting circuit 140 is approximately 90% of full range (e.g., 18 amps of a maximum 20 amps). At 232, clicking and holding the rotary dimmer switch 124 for a defined period of time (e.g., 1 second) causes the control circuitry 110 to exit the second configuration mode 204. At 234, double clicking the rotary dimmer switch 124 permits causes the control circuitry 110 to switch from configuring the overcurrent protection limit for overcurrent protection circuitry 164A to configuring the overcurrent protection limit for overcurrent protection circuitry 164B.

In the second configuration mode 204, at 240, the LED indicator 122 illuminates in a second color (e.g., blue) when configuring the overcurrent protection limit for the overcurrent protection circuitry 164B associated with the second lighting circuit 150. At 246, the partially illuminated LED indicator 122 indicates the overcurrent protection limit applied by the overcurrent protection circuitry 164B associated with the second lighting circuit 150 is approximately 10% of full range (e.g., 2 amps of a maximum 20 amps). At 248, the nearly fully illuminated LED indicator 122 indicates the overcurrent protection limit applied by the overcurrent protection circuitry 164B to the first lighting circuit 140 is approximately 90% of full range (e.g., 18 amps of a maximum 20 amps). At 242, clicking and holding the rotary dimmer switch 124 for a defined period of time (e.g., 1 second) causes the control circuitry 110 to exit the second configuration mode 204. At 244, double clicking the rotary dimmer switch 124 permits causes the control circuitry 110 to switch from configuring the overcurrent protection limit for overcurrent protection circuitry 164B to configuring the overcurrent protection limit for overcurrent protection circuitry 164A.

Figure 3:
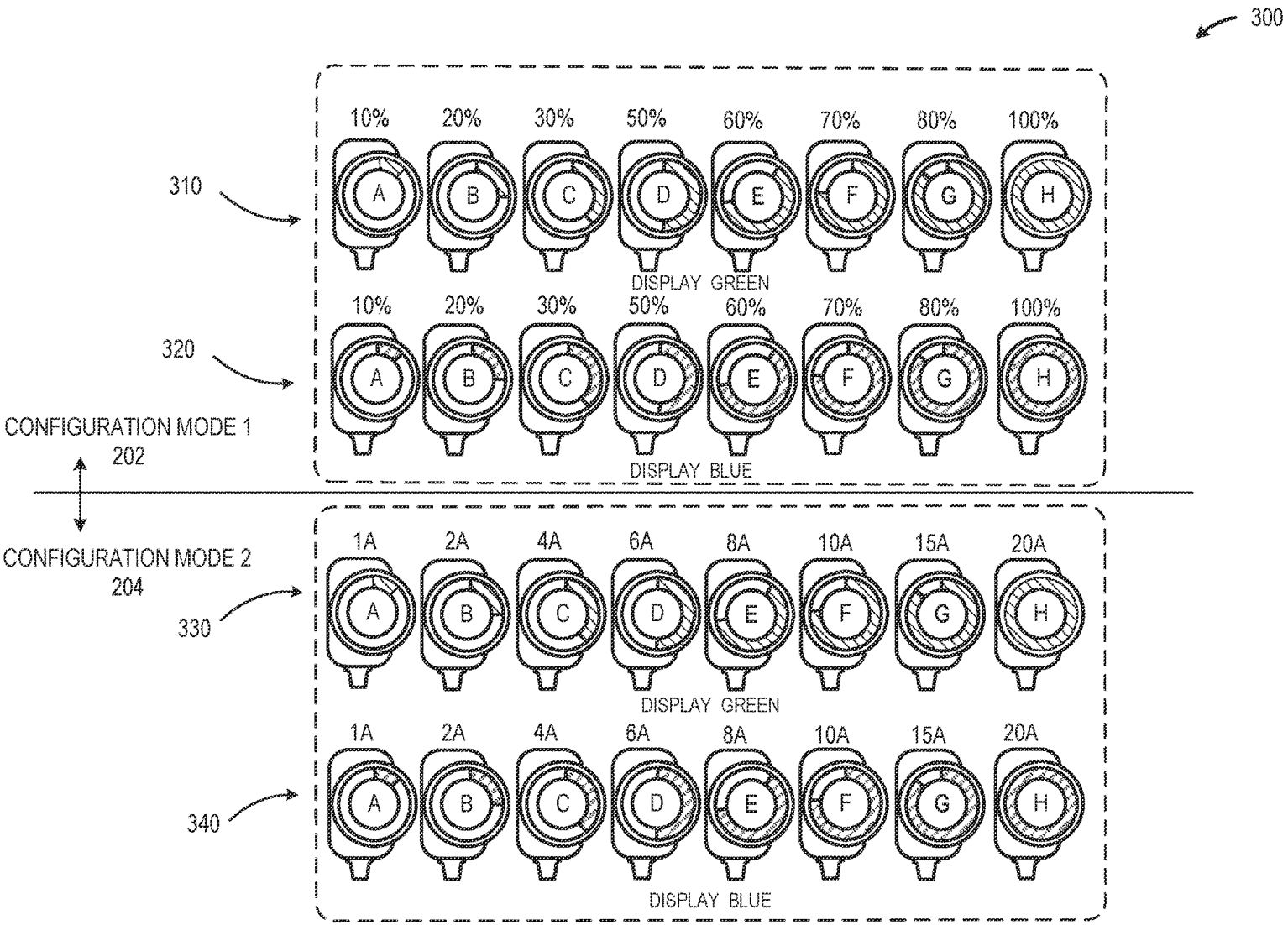
FIG. 3 depicts the example display outputs provided by the LED indicator for a variety of illustrative settings in both the first configuration mode and the second configuration mode, in accordance with at least one embodiment described herein.

FIG. 3 depicts the example display outputs provided by the LED indicator 122 for a variety of illustrative settings in both the first configuration mode 202 and the second configuration mode 204, in accordance with at least one embodiment described herein. Although illustrative settings are provided to ease discussion in FIG. 3, one of ordinary skill in the relevant arts will readily appreciate that the values depicted in FIG. 3 can be altered changed or adjusted. Also, although discussed in terms of adjusting power delivery to the first lighting circuit 140 and the second lighting circuit 150, other operational parameters associated with load devices operably coupled to the first lighting circuit 140 and/or the second lighting circuit 150 may be substituted for power delivery.

In the first configuration mode 202, at 310, the LED indicator 122 is illuminated in a first color indicating to the vehicle user that the adjustments entered using the rotary dimmer switch 124 display will be applied to the first lighting circuit 140. In the illustrative example depicted in FIG. 3, at 310A, the rotary dimmer switch 124 causes the control circuitry 110 to provide a power output to the first lighting circuit 140 of approximately 10% of full power output. Similarly, at 310B causes the control circuitry 110 to provide a power output to the first lighting circuit 140 of approximately 20% of full power output; 310C a power output of approximately 30% of full power output; 310D a power output of approximately 50% of full power output; 310E a power output of approximately 60% of full power output; 310F a power output of approximately 70% of full power output; 310G a power output of approximately 80% of full power output; and 310H a power output of approximately 100% of full power output.

At 320, the LED indicator 122 is illuminated in a second color indicating to the vehicle user that the adjustments entered using the rotary dimmer switch 124 display will be applied to the second lighting circuit 150. In the illustrative example depicted in FIG. 3, at 320A, the rotary dimmer switch 124 causes the control circuitry 110 to provide a power output to the second lighting circuit 150 of approximately 10% of full power output. Similarly, at 320B, the position of the rotary dimmer switch 124 causes the control circuitry 110 to provide a power output to the second lighting circuit 150 of approximately 20% of full power output; 320C a power output of approximately 30% of full power output; 320D a power output of approximately 50% of full power output; 320E a power output of approximately 60% of full power output; 320F a power output of approximately 70% of full power output; 320G a power output of approximately 80% of full power output; and 320H a power output of approximately 100% of full power output.

In the second configuration mode 204, at 330, the LED indicator 122 is illuminated in the first color indicating to the vehicle user that the adjustment to the overcurrent protection level entered using the rotary dimmer switch 124 will be applied to the overcurrent protection circuit 164A associated with the first lighting circuit 140. In the illustrative example depicted in FIG. 3, at 330A, the rotary dimmer switch 124 causes the overcurrent protection circuitry 164A to provide overcurrent protection to the first lighting circuit 140 of approximately 1 amp. Similarly, at 330B the rotary dimmer switch 124 causes the overcurrent protection circuitry 164A to provide overcurrent protection to the first lighting circuit 140 of approximately 2 amps; at 330C an overcurrent protection of approximately 4 amps; at 330D an overcurrent protection of approximately 6 amps; at 330E an overcurrent protection of approximately 8 amps; at 330F an overcurrent protection of approximately 10 amps; at 330G an overcurrent protection of approximately 15 amps; and at 330H an overcurrent protection of approximately 20 amps.

At 340, the LED indicator 122 is illuminated in a second color indicating to the vehicle user that the adjustment to the overcurrent protection level entered using the rotary dimmer switch 124 will be applied to the overcurrent protection circuit 164B associated with the second lighting circuit 150. In the illustrative example depicted in FIG. 3, at 340A, the rotary dimmer switch 124 causes the overcurrent protection circuitry 164B to provide overcurrent protection to the second lighting circuit 150 of approximately 1 amp. Similarly, at 340B the rotary dimmer switch 124 causes the overcurrent protection circuitry 164B to provide overcurrent protection to the second lighting circuit 150 of approximately 2 amps; at 340C an overcurrent protection of approximately 4 amps; at 340D an overcurrent protection of approximately 6 amps; at 340E an overcurrent protection of approximately 8 amps; at 340F an overcurrent protection of approximately 10 amps; at 340G an overcurrent protection of approximately 15 amps; and at 340H an overcurrent protection of approximately 20 amps.

Figure 4:
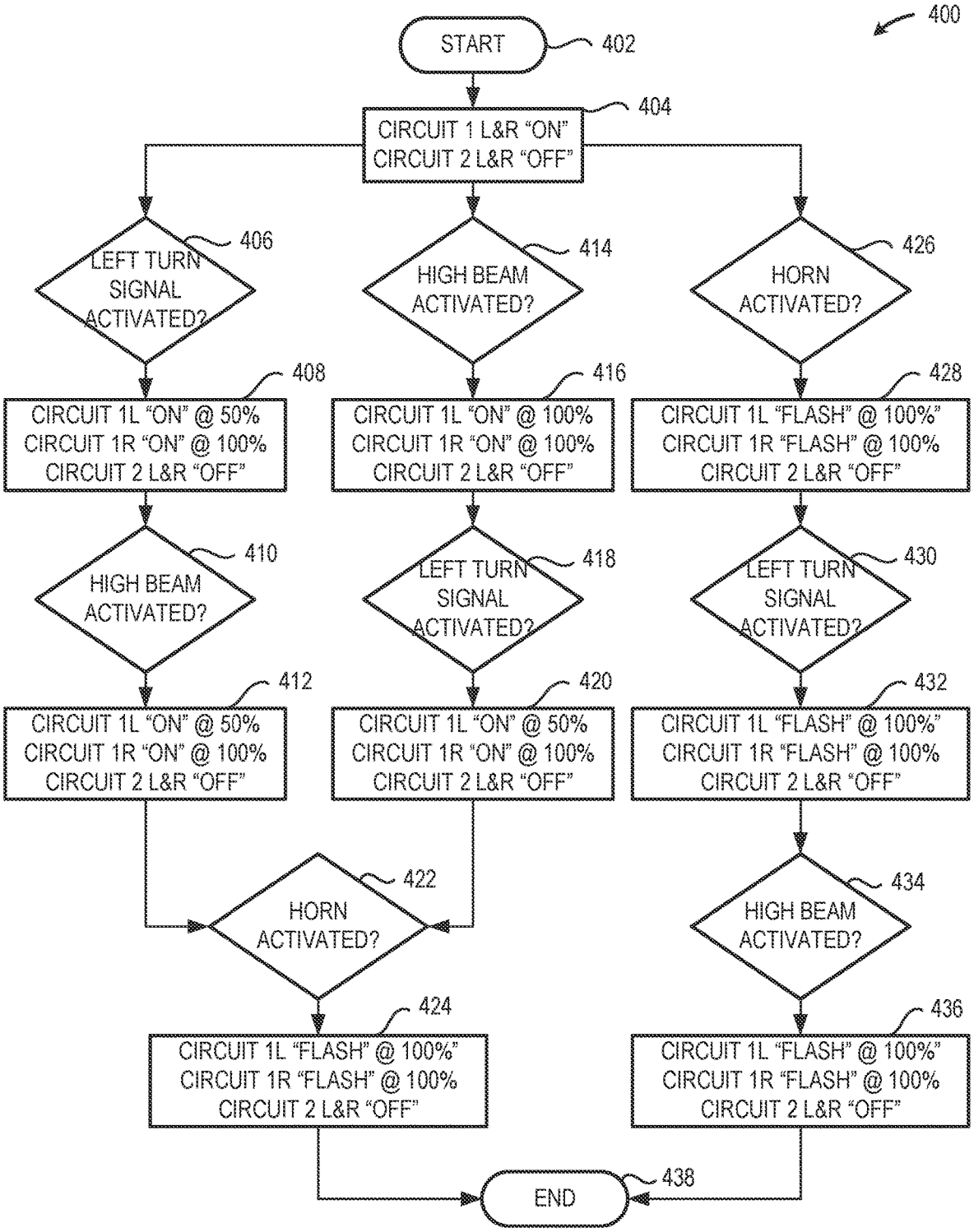
FIG. 4 is a flow diagram of an illustrative method of operating the second lighting circuit in response to an activation of various vehicular systems, in accordance with at least one embodiment described herein.

FIG. 4 is a flow diagram of an illustrative method 400 of operating the second lighting circuit 140 in response to an activation of various vehicular systems, in accordance with at least one embodiment described herein. In embodiments, the control circuitry 110 may execute one or more machine-readable instruction sets, programs, or applications that cause the control circuitry 110 to perform the illustrative method 400. It should be appreciated that the method 400 does not have to include all the steps/acts shown/described herein.

At 404, the first lighting circuit 140 (which may include one or more lighting circuits such as, but not limited to, a first or left lighting circuit 140L and a second or right lighting circuit 140R) are in an ON or powered state at 100% power and the second lighting circuit 150 is in an OFF or unpowered state at 0% power.

At 406, the control circuit 110 receives an input that the left turn indicator 134L has been activated.

At 408, responsive to a determination that the left turn indicator 134L has been activated, the control circuitry 110 reduces the power to the left lighting circuit 140L from 100% to 50% and causes the left lighting circuit 140L to "flash," for example by alternating the left lighting circuit 140L between a power ON state and a POWER OFF state at a defined frequency. The control circuitry 110 maintains the power supplied to the right lighting circuit 140R at 100%.

At 410, the control circuit 110 receives an input that the high beam headlight(s) 132 have been activated.

At 412 responsive to a determination that both the left turn indicator 134L and and the high beam headlight(s) 132 have been activated, the control circuitry 110 maintains the power to the left lighting circuit 140L at 50% and continues to cause the left lighting circuit 140L to "flash." The control circuitry 110 maintains the power supplied to the right lighting circuit 140R at 100%. The method continues at 422.

At 414, the control circuit 110 receives an input that the high beam headlight(s) 132 have been activated.

At 416 responsive to a determination that the high beam headlight(s) 132 have been activated, the control circuitry 110 maintains the power supplied to the left lighting circuit 140L at 100%. The control circuitry 110 maintains the power supplied to the right lighting circuit 140R at 100%.

At 418, the control circuit 110 receives an input that the left turn indicator 134L has been activated.

At 420 responsive to a determination that both the left turn indicator 134L and the high beam headlight(s) 132 have been activated, the control circuitry 110 reduces the power supplied to the left lighting circuit 140L from 100% to 50% and causes the left lighting circuit 140L to "flash." The control circuitry 110 maintains the power supplied to the right lighting circuit 140R at 100%. The method continues at 422.

At 422 the control circuitry 110 receives an input that the audible warning device 130 has been activated.

At 424 responsive to a determination that the audible warning device 130, the left turn indicator 134L, and the high beam headlight(s) 132 have been activated, the control circuitry 110 increases the power supplied to the left lighting circuit 140L from 50% to 100% and causes the left lighting circuit 140L to "flash." The control circuitry 110 maintains the power supplied to the right lighting circuit 140R at 100% and also causes the right lighting circuit 140R to "flash," for example by alternating the right lighting circuit 140R between a power ON state and a POWER OFF state at the defined frequency. The method concludes at 438.

At 426 the control circuitry 110 receives an input that the audible warning device 130 has been activated.

At 428 responsive to a determination that the audible warning device 130 has been activated, the control circuitry 110 maintains the power supplied to the left lighting circuit 140L at 100% and causes the left lighting circuit 140L to "flash." The control circuitry 110 maintains the power supplied to the right lighting circuit 140R at 100% and also causes the right lighting circuit 140R to "flash.".

At 430, the control circuit 110 receives an input that the left turn indicator 134L has been activated.

At 432 responsive to a determination that both the left turn indicator 134L and the audible warning device 130 have been activated, the control circuitry 110 maintains the power supplied to the left lighting circuit 140L at 100% and causes the left lighting circuit 140L to "flash." The control circuitry 110 maintains the power supplied to the right lighting circuit 140R at 100% and also causes the right lighting circuit 140R to "flash."

At 434, the control circuit 110 receives an input that the high beam headlight(s) 132 have been activated.

At 436 responsive to a determination that the left turn indicator 134L, the audible warning device 130, and the high beam headlight(s) 132 have been activated, the control circuitry 110 maintains the power supplied to the left lighting circuit 140L at 100% and causes the left lighting circuit 140L to "flash." The control circuitry 110 maintains the power supplied to the right lighting circuit 140R at 100% and also causes the right lighting circuit 140R to "flash." The method concludes at 438.

It should be appreciated that the percentages described in connection with FIG. 4 are provided for exemplary purposes and that the claimed invention is not limited to these percentages unless specifically claimed as such. One of ordinary skill in the art, upon reading the present disclosure, will understand that these percentages may be changed and may be used, for example, to establish relative amounts.

Figure 5:
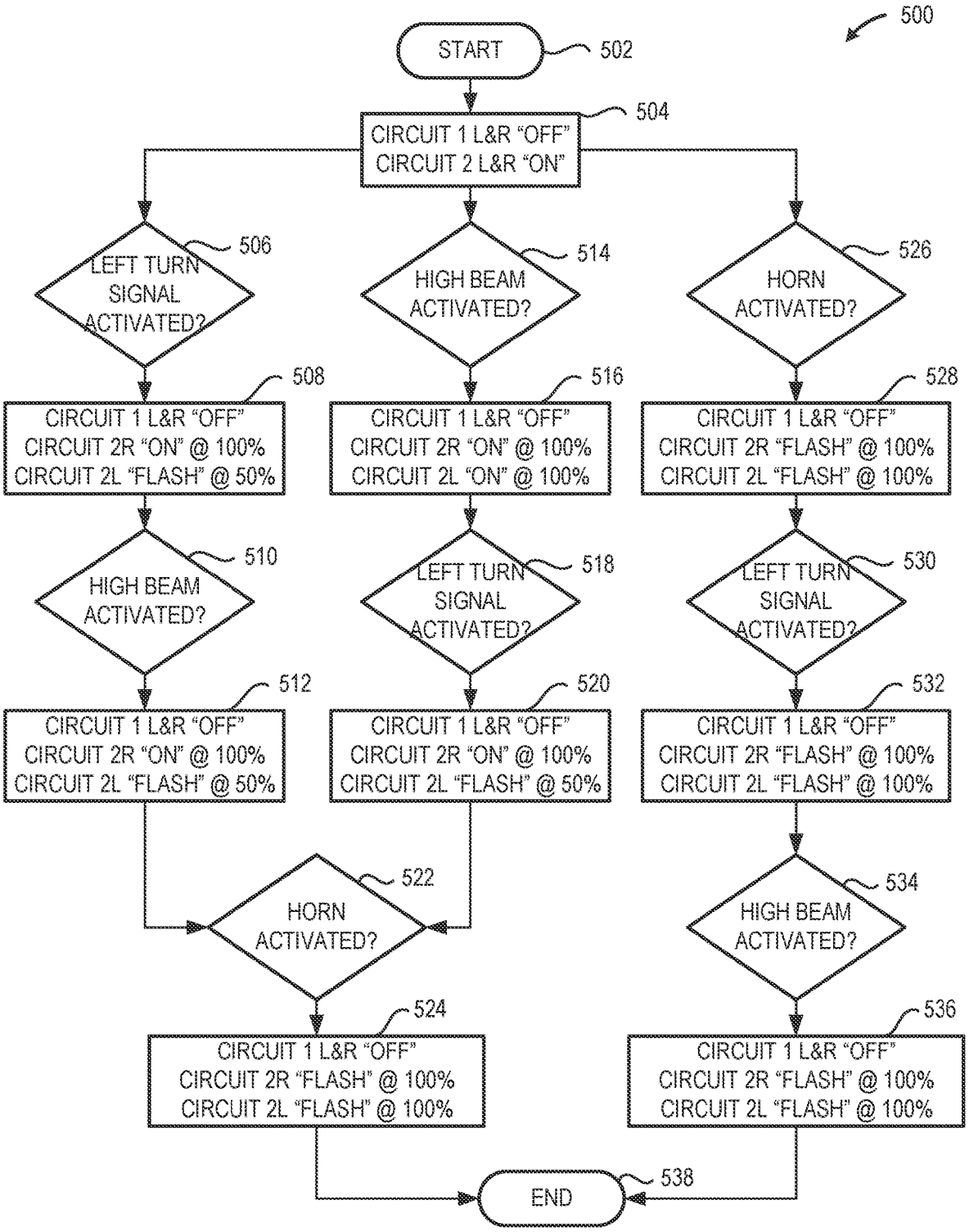
FIG. 5 is a flow diagram of an illustrative method of operating the second lighting circuit 150 in response to an activation of various vehicular systems, in accordance with at least one embodiment described herein.

FIG. 5 is a flow diagram of an illustrative method 500 of operating the second lighting circuit 150 in response to an activation of various vehicular systems, in accordance with at least one embodiment described herein. In embodiments, the control circuitry 110 may execute one or more machine-readable instruction sets, programs, or applications that cause the control circuitry 110 to perform the illustrative method 500. The method 500 commences at 502. It should be appreciated that the method 500 does not have to include all the steps/acts shown/described herein.

At 504, the second lighting circuit 150 (which may include one or more lighting circuits such as, but not limited to, a first or left lighting circuit 150L and a second or right lighting circuit 150R) are in an ON or powered state at 100% power and the first lighting circuit 140 is in an OFF or unpowered state at 0% power.

At 506, the control circuit 110 receives an input that the left turn indicator 134L has been activated.

At 508, responsive to a determination that the left turn indicator 134L has been activated, the control circuitry 110 reduces the power to the left lighting circuit 150L from 100% to 50% and causes the left lighting circuit 150L to "flash," for example by alternating the left lighting circuit 150L between a power ON state and a POWER OFF state at a defined frequency. The control circuitry 110 maintains the power supplied to the right lighting circuit 150R at 100%.

At 510, the control circuit 110 receives an input that the high beam headlight(s) 132 have been activated.

At 512 responsive to a determination that both the left turn indicator 134L and the high beam headlight(s) 132 have been activated, the control circuitry 110 maintains the power at 50% to the left lighting circuit 150L and continues to cause the left lighting circuit 150L to "flash." The control circuitry 110 maintains the power supplied to the right lighting circuit 150R at 100%. The method continues at 522.

At 514, the control circuit 110 receives an input that the high beam headlight(s) 132 have been activated.

At 516 responsive to a determination that only the high beam headlight(s) 132 have been activated, the control circuitry 110 maintains the power supplied to the left lighting circuit 150L at 100%. The control circuitry 110 also maintains the power supplied to the right lighting circuit 150R at 100%.

At 518, the control circuit 110 receives an input that the left turn indicator 134L has been activated.

At 520 responsive to a determination that both the left turn indicator 134L and the high beam headlight(s) 132 have been activated, the control circuitry 110 reduces the power supplied to the left lighting circuit 140L from 100% to 50% and causes the left lighting circuit 150L to "flash," for example by alternating the left lighting circuit 150L between the power ON state and the POWER OFF state at the defined frequency. The control circuitry 110 maintains the power supplied to the right lighting circuit 150R at 100%. The method continues at 422.

At 522 the control circuitry 110 receives an input that the audible warning device 130 has been activated.

At 524 responsive to a determination that the audible warning device 130, the left turn indicator 134L and the high beam headlight(s) 132 have been activated the control circuitry 110 increases the power supplied to the left lighting circuit 150L from 50% to 100% and causes the left lighting circuit 150L to "flash." The control circuitry 110 maintains the power supplied to the right lighting circuit 150R at 100% and also causes the right lighting circuit 150R to "flash," for example by alternating the right lighting circuit 140R between a power ON state and a POWER OFF state at the defined frequency. The method concludes at 538.

At 526 the control circuitry 110 receives an input that the audible warning device 130 has been activated.

At 528 responsive to a determination that the audible warning device 130 has been activated, the control circuitry 110 maintains the power supplied to the left lighting circuit 150L at 100% and causes the left lighting circuit 150L to "flash." The control circuitry 110 maintains the power supplied to the right lighting circuit 150R at 100% and also causes the right lighting circuit 150R to "flash."

At 530, the control circuit 110 receives an input that the left turn indicator 134L has been activated.

At 532 responsive to a determination that both the left turn indicator 134L and the audible warning device 130 have been activated, the control circuitry 110 maintains the power supplied to the left lighting circuit 150L at 100% and causes the left lighting circuit 150L to "flash." The control circuitry 110 maintains the power supplied to the right lighting circuit 140R at 100% and also causes the right lighting circuit 140R to "flash."

At 534, the control circuit 110 receives an input that the high beam headlight(s) 132 have been activated.

At 536 responsive to a determination that the left turn indicator 134L, the audible warning device 130, and the high beam headlight(s) 132 have been activated, the control circuitry 110 maintains the power supplied to the left lighting circuit 150L at 100% and causes the left lighting circuit 150L to "flash." The control circuitry 110 also maintains the power supplied to the right lighting circuit 150R at 100% and causes the right lighting circuit 150R to "flash." The method concludes at 538.

It should be appreciated that the percentages described in connection with FIG. 5 are provided for exemplary purposes and that the claimed invention is not limited to these percentages unless specifically claimed as such. One of ordinary skill in the art, upon reading the present disclosure, will understand that these percentages may be changed and may be used, for example, to establish relative amounts.

Figure 6:
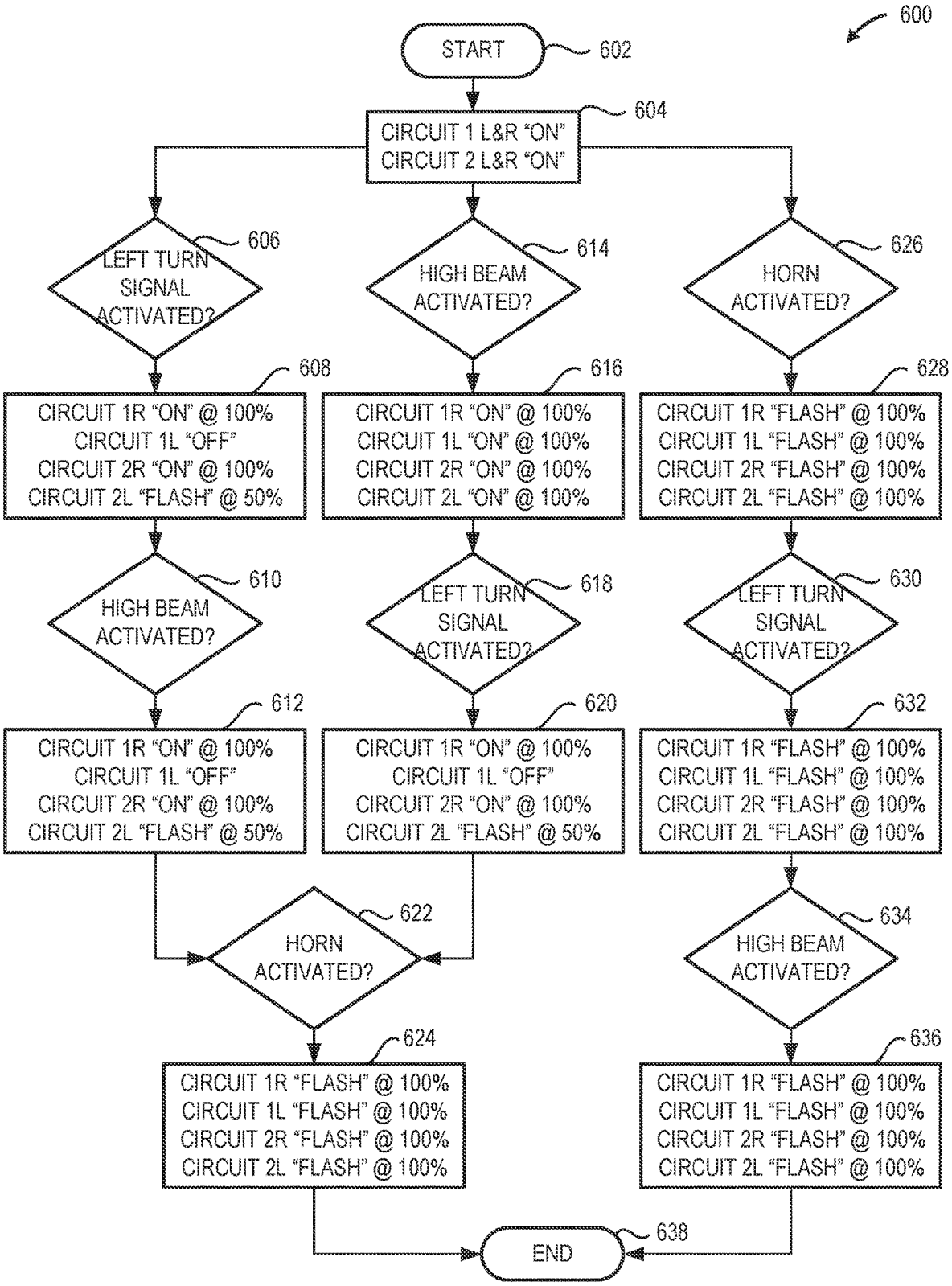
FIG. 6 is a flow diagram of an illustrative method of operating the first lighting circuit 140 and the second lighting circuit in response to an activation of various vehicular systems, in accordance with at least one embodiment described herein.

FIG. 6 is a flow diagram of an illustrative method 600 of operating the first lighting circuit 140 and the second lighting circuit 150 in response to an activation of various vehicular systems, in accordance with at least one embodiment described herein. In embodiments, the control circuitry 110 may execute one or more machine-readable instruction sets, programs, or applications that cause the control circuitry 110 to perform the illustrative method 600. The method 600 commences at 602. It should be appreciated that the method 600 does not have to include all the steps/acts shown/described herein.

At 604, the first lighting circuit 140 (which may include one or more lighting circuits such as, but not limited to, a first or left lighting circuit 140L and a second or right lighting circuit 140R) are in an ON or powered state at 100% power and the second lighting circuit 150, including the left lighting circuit 150L and the right lighting circuit 150R are in an ON or powered state at 100% power.

At 606, the control circuit 110 receives an input that the left turn indicator 134L has been activated.

At 608, responsive to a determination that the left turn indicator 134L has been activated, the control circuitry 110 reduces the power to the first left lighting circuit 140L from 100% to 0% and reduces the power to the second left lighting circuit 150L from 100% to 50% and causes the second left lighting circuit 150L to "flash," for example by alternating the left lighting circuit 150L between a power ON state and a POWER OFF state at a defined frequency. The control circuitry 110 maintains the power supplied to the first right lighting circuit 140R at 100% and the power supplied to the second right lighting circuit 150R at 100%.

At 610, the control circuit 110 receives an input that the high beam headlight(s) 132 have been activated.

At 612 responsive to a determination that both the left turn indicator 134L and the high beam headlight(s) 132 have been activated, the control circuitry 110 maintains the power to the first left lighting circuit 140L at 0% and maintains the power to the second left lighting circuit 150L to 50% and causes the second left lighting circuit 150L to "flash." The control circuitry 110 maintains the power supplied to the first right lighting circuit 140R at 100% and the power supplied to the second right lighting circuit 150R at 100%. The method continues at 622.

At 614, the control circuit 110 receives an input that the high beam headlight(s) 132 have been activated.

At 616 responsive to a determination that only the high beam headlight(s) 132 have been activated, the control circuitry 110 maintains the power supplied to the first left lighting circuit 140L at 100% and maintains the power supplied to the left lighting circuit 150L at 100%. The control circuitry 110 also maintains the power supplied to the first right lighting circuit 140R at 100% and the second right lighting circuit 150R at 100%.

At 618, the control circuit 110 receives an input that the left turn indicator 134L has been activated.

At 620 responsive to a determination that both the left turn indicator 134L and the high beam headlight(s) 132 have been activated, the control circuitry 110 reduces the power to the first left lighting circuit 140L from 100% to 0% and reduces the power to the second left lighting circuit 150L from 100% to 50% and causes the second left lighting circuit 150L to "flash," for example by alternating the left lighting circuit 150L between a power ON state and a POWER OFF state at a defined frequency. The control circuitry 110 maintains the power supplied to the first right lighting circuit 140R at 100% and the power supplied to the second right lighting circuit 150R at 100%. The method continues at 622.

At 622 the control circuitry 110 receives an input that the audible warning device 130 has been activated.

At 624 responsive to a determination that the audible warning device 130, the left turn indicator 134L and the high beam headlight(s) 132 have been activated, the control circuitry 110 increases the power to the first left lighting circuit 140L from 0% to 100%, increases the and reduces the power to the second left lighting circuit 150L from 50% to 100% and causes both the first left lighting circuit 140L and the second left lighting circuit 150L to "flash." The control circuitry 110 maintains the power supplied to the first right lighting circuit 140R at 100% and the power supplied to the second right lighting circuit 150R at 100% and causes both the first right lighting circuit 140R and the second right lighting circuit 150R to "flash."

At 626 the control circuitry 110 receives an input that the audible warning device 130 has been activated.

At 628 responsive to a determination that the audible warning device 130 has been activated, the control circuitry 110 maintains the power to both the first left lighting circuit 140L and the second left lighting circuit 150L at 100%, and causes both the first left lighting circuit 140L and the second left lighting circuit 150L to "flash." The control circuitry 110 maintains the power supplied to both the first right lighting circuit 140R and the second right lighting circuit 150R at 100% and causes both the first right lighting circuit 140R and the second right lighting circuit 150R to "flash."

At 630, the control circuit 110 receives an input that the left turn indicator 134L has been activated.

At 632 responsive to a determination that both the left turn indicator 134L and the audible warning device 130 have been activated, the control circuitry 110 maintains the power to both the first left lighting circuit 140L and the second left lighting circuit 150L at 100%, and causes both the first left lighting circuit 140L and the second left lighting circuit 150L to "flash." The control circuitry 110 maintains the power supplied to both the first right lighting circuit 140R and the second right lighting circuit 150R at 100% and causes both the first right lighting circuit 140R and the second right lighting circuit 150R to "flash."

At 634, the control circuit 110 receives an input that the high beam headlight(s) 132 have been activated.

At 636 responsive to a determination that the left turn indicator 134L, the audible warning device 130, and the high beam headlight(s) 132 have been activated, the control circuitry 110 maintains the power to both the first left lighting circuit 140L and the second left lighting circuit 150L at 100%, and causes both the first left lighting circuit 140L and the second left lighting circuit 150L to "flash." The control circuitry 110 maintains the power supplied to both the first right lighting circuit 140R and the second right lighting circuit 150R at 100% and causes both the first right lighting circuit 140R and the second right lighting circuit 150R to "flash." The method concludes at 638.

It should be appreciated that the percentages described in connection with FIG. 6 are provided for exemplary purposes and that the claimed invention is not limited to these percentages unless specifically claimed as such. One of ordinary skill in the art, upon reading the present disclosure, will understand that these percentages may be changed and may be used, for example, to establish relative amounts.

As used in this application and in the claims, a list of items joined by the term "and/or" can mean any combination of the listed items. For example, the phrase "A, B and/or C" can mean A; B; C; A and B; A and C; B and C; or A, B and C. As used in this application and in the claims, a list of items joined by the term "at least one of" can mean any combination of the listed terms. For example, the phrases "at least one of A, B or C" can mean A; B; C; A and B; A and C; B and C; or A, B and C.

As used in any embodiment herein, the terms "system" or "module" may refer to, for example, software, firmware and/or circuitry configured to perform any of the aforementioned operations. Software may be embodied as a software package, code, instructions, instruction sets and/or data recorded on non-transitory computer readable storage mediums. Firmware may be embodied as code, instructions or instruction sets and/or data that are hard-coded (e.g., non-volatile) in memory devices.

As used in any embodiment herein, the term "circuitry" may comprise, for example, singly or in any combination, hardwired circuitry, programmable circuitry such as computer processors comprising one or more individual instruction processing cores, state machine circuitry, and/or firmware that stores instructions executed by programmable circuitry or future computing paradigms including, for example, massive parallelism, analog or quantum computing, hardware embodiments of accelerators such as neural net processors and non-silicon implementations of the above. The circuitry may, collectively or individually, be embodied as circuitry that forms part of a larger system, for example, an integrated circuit (IC), system on-chip (SoC), desktop computers, laptop computers, tablet computers, servers, smartphones, etc.

Any of the operations described herein may be implemented in a system that includes one or more mediums (e.g., non-transitory storage mediums) having stored therein, individually or in combination, instructions that when executed by one or more processors perform the methods. Here, the processor may include, for example, a server CPU, a mobile device CPU, and/or other programmable circuitry. Also, it is intended that operations described herein may be distributed across a plurality of physical devices, such as processing structures at more than one different physical location. The storage medium may include any type of tangible medium, for example, any type of disk including hard disks, floppy disks, optical disks, compact disk read-only memories (CD-ROMs), compact disk rewritables (CD-RWs), and magneto-optical disks, semiconductor devices such as read-only memories (ROMs), random access memories (RAMs) such as dynamic and static RAMs, erasable programmable read-only memories (EPROMs), electrically erasable programmable read-only memories (EEPROMs), flash memories, Solid State Disks (SSDs), embedded multimedia cards (eMMCs), secure digital input/output (SDIO) cards, magnetic or optical cards, or any type of media suitable for storing electronic instructions. Other embodiments may be implemented as software executed by a programmable control device.

Thus, the present disclosure is directed to vehicle lighting systems. The system includes a rotatable, depressible, rotary dimmer switch with a light emitting diode indicator and a vehicle lighting controller. The vehicle lighting controller controls the operation of at least a first lighting circuit and a second lighting circuit (and optionally additional lighting circuits and/or other non-lighting circuits). A digital input from the rotary dimmer switch places the controller in a first configuration mode or a second configuration mode. The digital input from the rotary dimmer also switches between apply configuring the first lighting circuit or the second lighting circuit. The LED illuminates in a first color for the first circuit and a second color for the second circuit. The rotary dimmer adjusts the operating parameter and/or the overcurrent protection associated with the first lighting circuit and the second lighting circuit. The LED ring indicator sequentially illuminates and is indicative of the operational parameter or overcurrent protection associated with the respective lighting circuit.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents. Various features, aspects, and embodiments have been described herein. The features, aspects, and embodiments are susceptible to combination with one another as well as to variation and modification, as will be understood by those having skill in the art. The present disclosure should, therefore, be considered to encompass such combinations, variations, and modifications.

As described herein, various embodiments may be implemented using hardware elements, software elements, or any combination thereof. Examples of hardware elements may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth.

According to example 1, there is provided a vehicle lighting control system. The system may include: a user input device that includes: a rotatable and depressible rotary dimmer switch having a crown and a base, the dimmer switch to provide a first output when depressed and a second output when rotated; a multi-color light emitting diode (LED) indicator disposed proximate and about at least a portion of the base of the rotary dimmer switch; control circuitry that includes: at least one input signal interface to: receive signals from each of a plurality of vehicular systems; receive the first output and the second output from the dimmer switch; at least one output signal interface to: provide a first output signal to control one or more operational parameters associated with a first lighting circuit (the first lighting circuit may include a first light and optionally a second light); and provide a second output signal to control one or more operational parameters associated with a second lighting circuit, (the second lighting circuit may include a first light and optionally a second light); at least one adjustable overcurrent protection device; non-transitory storage circuitry to store one or more machine-readable instruction sets; and processor circuitry to: enter a first configuration mode or a second configuration mode upon receipt of the first signal from the dimmer switch; receive the second signal from the dimmer switch and adjust the one or more operational parameters of at least one of the first lighting circuit or the second lighting circuit upon entering the first configuration mode; and receive the second signal from the dimmer switch and adjust an overcurrent protection level of at least one of the first lighting circuit or the second lighting circuit upon entering the second configuration mode.

Example 2 may include elements of example 1 and the processor circuitry may further: cause the LED indicator to illuminate in a first color when adjusting the one or more operational parameters or adjusting an overcurrent protection level associated with the first lighting circuit.

Example 3 may include elements of any of examples 1 or 2 and the processor circuitry may further: cause the LED indicator to illuminate in a second color when adjusting the one or more operational parameters or adjusting an overcurrent protection level associated with the second lighting circuit.

Example 4 may include elements of any of examples 1 through 3 where the control circuitry further includes at least one pulse-width modulated (PWM) power supply to supply power to at least one of the first lighting circuit or the second lighting circuit.

Example 5 may include elements of any of examples 1 through 4 where the one or more operational parameters include the PWM power delivered to at least one of the first lighting circuit or the second lighting circuit.

Example 6 may include elements of any of examples 1 through 5 where, in the first configuration mode, an illuminated portion of the LED indicator is indicative of the PWM power delivered to at least one of the first lighting circuit or the second lighting circuit.

Example 7 may include elements of any of examples 1 through 6 where, in the second configuration mode, an illuminated portion of the LED indicator is indicative of the overcurrent protection level associated with at least one of the first lighting circuit or the second lighting circuit.

Example 8 may include elements of any of examples 1 through 7 where the plurality of vehicle control systems include: an audible warning device circuit; a high-beam headlamp circuit; a right turn signal circuit; and a left turn signal circuit.

Example 9 may include elements of any of examples 1 through 8 and the processor circuitry may further: cause at least one of a first left lighting circuit or a second left lighting circuit of the first lighting circuit and the second lighting circuits, respectively, to flash upon receipt of an input signal indicative of an activation of the left turn signal circuit.

Example 10 may include elements of any of examples 1 through 9 where the processor circuitry may further: cause at least one of the first right lighting circuit or the second right lighting circuit of the first lighting circuit and the second lighting circuits, respectively, to flash upon receipt of an input signal indicative of an activation of the right turn signal circuit.

Example 11 may include elements of any of examples 1 through 10 where the processor circuitry may further: cause power delivered to at least one of the first lighting circuit or the second lighting circuit to increase power level upon receipt of an input signal indicative of an activation of the high-beam headlamp circuit.

Example 12 may include elements of any of examples 1 through 11 where the processor circuitry may further: cause power delivered to at least one of the first lighting circuit or the second lighting circuit to increase power level; and cause at least one of the first lighting circuit or the second lighting circuit to flash upon receipt of upon receipt of an input signal indicative of an activation of the audible warning device circuit.

According to example 13, there is provided a vehicle lighting controller. The controller may include: at least one input signal interface to: receive signals from each of a plurality of vehicular systems; receive an first output and a second output from a dimmer switch; at least one output signal interface to: provide a first output signal to control one or more operational parameters associated with a first lighting circuit, the first lighting circuit including a first left lighting circuit and a first right lighting circuit; and provide a second output signal to control one or more operational parameters associated with a second lighting circuit, the second lighting circuit including a second left lighting circuit and a second right lighting circuit; at least one adjustable overcurrent protection device; non-transitory storage circuitry to store one or more machine-readable instruction sets; and processor circuitry to: enter at least one of a first configuration mode or a second configuration mode upon receipt of the second signal from the dimmer switch; receive the first signal from the dimmer switch and adjust the one or more operational parameters of at least one of the first lighting circuit or the second lighting circuit upon entering the first configuration mode; and receive the first signal from the dimmer switch and adjust an overcurrent protection level of at least one of the first lighting circuit or the second lighting circuit upon entering the second configuration mode.

Example 14 may include elements of example 13 and the processor circuitry may further: cause an LED indicator disposed at least partially about the dimmer switch to illuminate in a first color when adjusting the one or more operational parameters or adjusting an overcurrent protection level associated with the first lighting circuit.

Example 15 may include elements of any of examples 13 or 14 and the processor circuitry may further: cause the LED indicator to illuminate in a second color when adjusting the one or more operational parameters or adjusting an overcurrent protection level associated with the second lighting circuit.

Example 16 may include elements of any of examples 13 through 15 and the controller may further include at least one pulse-width modulated (PWM) power supply to supply power to at least one of the first lighting circuit or the second lighting circuit.

Example 17 may include elements of any of examples 13 through 16 where the one or more operational parameters include the PWM power delivered to at least one of the first lighting circuit or the second lighting circuit.

Example 18 may include elements of any of examples 13 through 17 and the processor circuitry may further: cause an illumination of at least a portion of the LED indicator indicative of the PWM power delivered to at least one of the first lighting circuit or the second lighting circuit when in the first configuration mode.

Example 19 may include elements of any of examples 13 through 18 and the processor circuitry to further: cause an illumination of at least a portion of the LED indicator indicative of the overcurrent protection level associated with at least one of the first lighting circuit or the second lighting circuit when in the second configuration mode.

Example 20 may include elements of any of examples 13 through 19 where the plurality of vehicle control systems include one or more of: an audible warning device circuit; a high-beam headlamp circuit; a right turn signal circuit; and a left turn signal circuit.

Example 21 may include elements of any of examples 13 through 20 and the processor circuitry may further: cause at least one of the first left lighting circuit or the second left lighting circuit to flash upon receipt of an input signal indicative of an activation of the left turn signal circuit.

Example 22 may include elements of any of examples 13 through 21 and the processor circuitry may further: cause at least one of the first right lighting circuit or the second right lighting circuit to flash upon receipt of an input signal indicative of an activation of the right turn signal circuit.

Example 23 may include elements of any of examples 13 through 22 and the processor circuitry may further: cause power delivered to at least one of the first lighting circuit or the second lighting circuit to increase to a maximum power level upon receipt of an input signal indicative of an activation of the high-beam headlamp circuit.

Example 24 may include elements of any of examples 13 through 23 and the processor circuitry may further: cause power delivered to at least one of the first lighting circuit or the second lighting circuit to increase to a maximum power level; and cause at least one of the first lighting circuit or the second lighting circuit to flash upon receipt of upon receipt of an input signal indicative of an activation of the audible warning device circuit.

Reference throughout this specification to "one embodiment" or "an embodiment" means that a particular feature, structure, or characteristic described in connection with the embodiment is included in at least one embodiment. Thus, appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

What is claimed:

1. A vehicle lighting control system, comprising:

a user input device including:

a rotatable and depressible rotary dimmer switch, the dimmer switch to provide a digital output when depressed and an analog output when rotated;

a multi-color light emitting diode (LED) indicator disposed proximate to and about at least a portion of the rotary dimmer switch;

control circuitry including:

at least one input signal interface configured to:

receive signals from each of a plurality of vehicular systems;

receive the analog output and the digital output from the dimmer switch;

at least one output signal interface configured to:

provide a first output signal to control one or more operational parameters associated with a first lighting circuit; and provide a second output signal to control one or more operational parameters associated with a second lighting circuit;

at least one adjustable overcurrent protection device;

non-transitory storage circuitry to store one or more machine-readable instruction sets; and processor circuitry configured to:

enter a first configuration mode or a second configuration mode upon receipt of the digital signal from the dimmer switch;

receive the analog signal from the dimmer switch and adjust the one or more operational parameters of at least one of the first lighting circuit or the second lighting circuit upon entering the first configuration mode; and receive the analog signal from the dimmer switch and adjust an overcurrent protection level of at least one of the first lighting circuit or the second lighting circuit upon entering the second configuration mode.

2. The system of claim 1, the processor circuitry to further:

cause the LED indicator to illuminate in a first color when adjusting the one or more operational parameters or adjusting an overcurrent protection level associated with the first lighting circuit.

3. The system of claim 1, the processor circuitry to further:

cause the LED ring indicator to illuminate in a second color when adjusting the one or more operational parameters or adjusting an overcurrent protection level associated with the second lighting circuit.

4. The system of claim 1 wherein the control circuitry further includes at least one pulse-width modulated (PWM) power supply to supply power to at least one of the first lighting circuit or the second lighting circuit.

5. The system of claim 4 wherein the one or more operational parameters include the PWM power delivered to at least one of the first lighting circuit or the second lighting circuit.

6. The system of claim 5 wherein, in the first configuration mode, an illuminated portion of the LED indicator is indicative of the PWM power delivered to at least one of the first lighting circuit or the second lighting circuit.

7. The system of claim 1 wherein, in the second configuration mode, an illuminated portion of the LED indicator is indicative of the overcurrent protection level associated with at least one of the first lighting circuit or the second lighting circuit.

8. The system of claim 1 wherein the processor circuitry is further configured to:

cause at least one of the first lighting circuit or the second lighting circuit to flash upon receipt of an input signal indicative of an activation of a left turn signal circuit.

9. The system of claim 1 wherein the processor circuitry to further:

cause power delivered to at least one of the first lighting circuit or the second lighting circuit to increase to about a maximum power level upon receipt of an input signal indicative of an activation of a high-beam headlamp circuit.

10. The system of claim 1 wherein the processor circuitry to further:

cause power delivered to at least one of the first lighting circuit or the second lighting circuit to increase to about a maximum power level; and cause at least one of the first lighting circuit or the second lighting circuit to flash upon receipt of an input signal indicative of an activation of an audible warning device circuit.

11. A vehicle lighting controller comprising:

at least one input signal interface to:

receive signals from each of a plurality of vehicular systems;

receive one or more dimmer output signals from a dimmer switch;

at least one output signal interface to:

provide a first output signal to control one or more operational parameters associated with a first lighting circuit; and provide a second output signal to control one or more operational parameters associated with a second lighting circuit;

at least one adjustable overcurrent protection device; and processor circuitry to:

enter at least one of a first configuration mode or a second configuration mode upon receipt of the one or more dimmer output signals;

receive the one or more dimmer output signals and adjust the one or more operational parameters of at least one of the first lighting circuit or the second lighting circuit upon entering the first configuration mode; and receive the one or more dimmer output signals and adjust an overcurrent protection level of at least one of the first lighting circuit or the second lighting circuit upon entering the second configuration mode.

12. The controller of claim 11, the processor circuitry to further:

cause an LED indicator disposed at least partially about the dimmer switch to illuminate in a first color when adjusting the one or more operational parameters or adjusting an overcurrent protection level associated with the first lighting circuit.

13. The controller of claim 12, the processor circuitry to further:

cause the LED indicator to illuminate in a second color when adjusting the one or more operational parameters or adjusting an overcurrent protection level associated with the second lighting circuit.

14. The controller of claim 12, further comprising:

at least one pulse-width modulated (PWM) power supply to supply power to at least one of the first lighting circuit or the second lighting circuit.

15. The controller of claim 14 wherein the one or more operational parameters include the PWM power delivered to at least one of the first lighting circuit or the second lighting circuit.

16. The controller of claim 15, the processor circuitry to further:

cause an illumination of at least a portion of the LED indicator indicative of the PWM power delivered to at least one of the first lighting circuit or the second lighting circuit when in the first configuration mode.

17. The controller of claim 12, the processor circuitry to further:

cause an illumination of at least a portion of the LED indicator indicative of the overcurrent protection level associated with at least one of the first lighting circuit or the second lighting circuit when in the second configuration mode.

18. The controller of claim 11, the processor circuitry to further:

cause at least one of the first left lighting circuit or the second left lighting circuit to flash upon receipt of an input signal indicative of an activation of a turn signal circuit.

19. The controller of claim 11, the processor circuitry to further:

cause power delivered to at least one of the first lighting circuit or the second lighting circuit to increase a power level upon receipt of an input signal indicative of an activation of a high-beam headlamp circuit.

20. The controller of claim 11, the processor circuitry to further:

cause power delivered to at least one of the first lighting circuit or the second lighting circuit to increase a power level; and cause at least one of the first lighting circuit or the second lighting circuit to flash upon receipt of upon receipt of an input signal indicative of an activation of an audible warning device circuit.

* * * * *